US006302031B1

(12) United States Patent
Smith et al.

(10) Patent No.: US 6,302,031 B1
(45) Date of Patent: Oct. 16, 2001

(54) SIDEWALL FOR A RAILWAY CAR

(75) Inventors: Stephen W. Smith, Dallas; John W. Coulborn, Fort Worth, both of TX (US)

(73) Assignee: TRN Business Trust, Dallas, TX (US)

( * ) Notice: Subject to any disclaimer, the term of this patent is extended or adjusted under 35 U.S.C. 154(b) by 0 days.

(21) Appl. No.: 09/313,788

(22) Filed: May 17, 1999

Related U.S. Application Data

(60) Provisional application No. 60/086,099, filed on May 20, 1998.

(51) Int. Cl.[7] ..... B61D 17/00

(52) U.S. Cl. ..... 105/404; 105/396; 105/355; 105/409; 105/401

(58) Field of Search ..... 105/238.1, 355, 105/396, 401, 404, 406.1, 409

(56) References Cited

U.S. PATENT DOCUMENTS

| | | | | |
|---|---|---|---|---|
| 2,054,783 | | 9/1936 | Gilpin | 105/409 |
| 2,074,439 | * | 3/1937 | Tangerman | 105/406.1 |
| 2,140,268 | * | 12/1938 | Moss | 105/401 |
| 2,901,283 | | 8/1959 | Curell | 296/28 |
| 3,583,331 | | 6/1971 | Mowatt-Larseen | 105/360 |
| 3,593,675 | | 7/1971 | Dominguez | 105/404 |
| 3,664,270 | | 5/1972 | Stark et al. | 105/377 |
| 3,677,196 | | 7/1972 | Schuller | 105/377 |
| 3,786,764 | | 1/1974 | Beers, Jr. et al. | 105/240 |
| 3,789,773 | | 2/1974 | McNally et al. | 105/248 |
| 3,801,177 | * | 4/1974 | Donald | 105/406.1 |
| 3,815,514 | | 6/1974 | Heap | 105/240 |
| 3,818,842 | | 6/1974 | Heap | 105/240 |
| 3,842,755 | | 10/1974 | Carr | 105/480 |
| 3,844,229 | | 10/1974 | Martin | 105/248 |
| 3,853,071 | * | 12/1974 | Snyder et al. | 105/409 |
| 3,902,434 | | 9/1975 | Barnard et al. | 105/240 |
| 3,914,847 | | 10/1975 | Martin | 29/469 |
| 4,275,662 | | 6/1981 | Adler et al. | 105/377 |
| 4,286,524 | | 9/1981 | Jantzen | 105/248 |
| 4,348,962 | | 9/1982 | Smith | 105/248 |
| 4,362,111 | | 12/1982 | Stark et al. | 106/247 |
| 4,377,058 | | 3/1983 | Hallam et al. | 52/45 |
| 4,444,123 | | 4/1984 | Smith et al. | 105/377 |
| 4,484,527 | | 11/1984 | O'Hara | 105/247 |
| 4,484,528 | | 11/1984 | Anderson et al. | 105/248 |
| 4,569,289 | | 2/1986 | Gielow et al. | 105/2 R |
| 4,598,656 | | 7/1986 | Dugge et al. | 105/248 |
| 4,617,868 | | 10/1986 | Wahlstrom et al. | 105/282 |
| 4,620,487 | | 11/1986 | Gielow et al. | 105/2 R |
| 4,633,787 | | 1/1987 | Przybylinski et al. | 105/406 |
| 4,677,917 | | 7/1987 | Dugge et al. | 105/248 |
| 4,690,072 | | 9/1987 | Wille et al. | 105/406 |
| 4,771,705 | | 9/1988 | Przybylinski et al. | 105/414 |

(List continued on next page.)

OTHER PUBLICATIONS

Trinity Aluminum Rapid Discharge IV General Specifications, RSB RDIV 0996/3M

Rolling Stock Light BeghGon LW™RSA Show Car, Johnstown America Corporation.

*Primary Examiner*—Russell D. Stormer
*Assistant Examiner*—Frantz F. Jules
(74) *Attorney, Agent, or Firm*—Baker Botts L.L.P.

(57) ABSTRACT

A railway car with a pair of improved sidewalls is provided. For some applications, the railway car may include a steel railway car underframe with an aluminum body mounted thereon. The car body preferably includes a pair of sidewalls and a pair of end walls. The car body may have an open top or a roof mounted thereon. Relatively, thin side posts are disposed on the exterior of the sidewalls to allow increasing cargo carrying capacity of the railway car. At least one longitudinal stiffener is disposed along the interior surface of each sidewall to provide sufficient strength for the sidewall based on anticipated loading while at the same time allowing reducing the number and the thickness of the side posts. For some applications the side posts and the longitudinal stiffeners may be formed by an extrusion process with substantially the same cross section.

15 Claims, 4 Drawing Sheets

U.S. PATENT DOCUMENTS

| | | | | |
|---|---|---|---|---|
| 4,840,127 | | 6/1989 | Tomaka | 105/406 |
| 4,898,101 | | 2/1990 | Harter | 105/247 |
| 4,909,154 | | 3/1990 | Walker | 105/1.1 |
| 5,109,777 | * | 5/1992 | Ohmura et al. | 105/401 |
| 5,119,738 | | 6/1992 | Snead | 105/247 |
| 5,209,166 | | 5/1993 | Tylisz et al. | 105/1.1 |
| 5,335,603 | | 8/1994 | Wirick et al. | 105/406 |
| 5,584,252 | * | 12/1996 | Smith et al. | 105/409 |
| 5,727,475 | | 3/1998 | Kurtz | 105/406 |

* cited by examiner

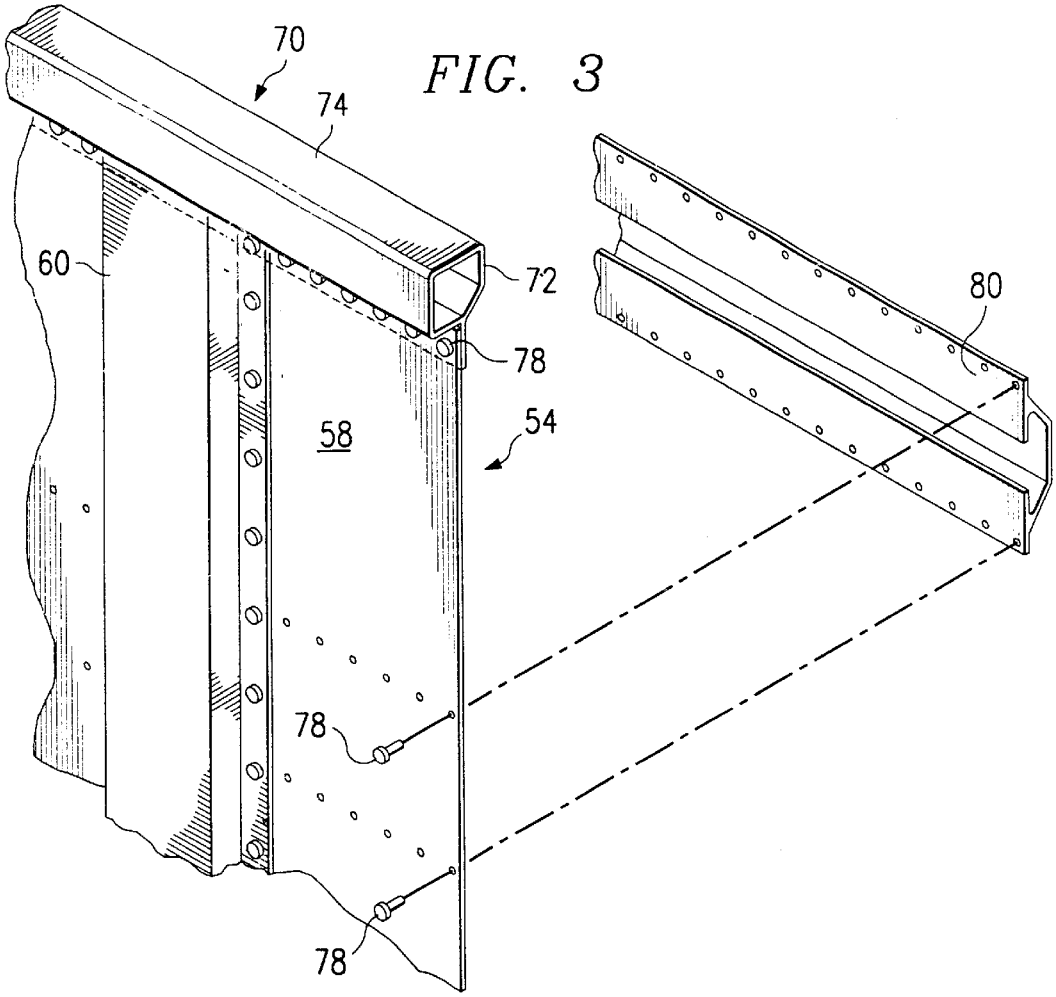
FIG. 3
FIG. 6
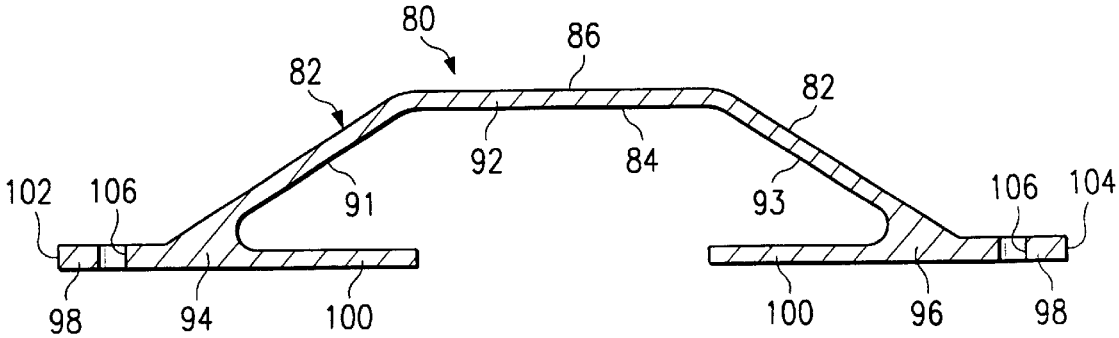

SIDEWALL FOR A RAILWAY CAR

RELATED APPLICATIONS

This application claims the benefit of U.S. Provisional Application Ser. No. 60/086,099 filed May 20, 1998.

TECHNICAL FIELD OF THE INVENTION

This invention relates in general to the field of railway cars and more particularly to railway cars having sidewalls.

BACKGROUND OF THE INVENTION

Railway cars are often used to transport bulk commodities and materials. In transporting such lading, it is desirable to provide railway cars that are efficient with respect to cost and ease of manufacture, load carrying capacity and energy required to move the cars throughout a railway system. Also, railway cars must be designed to meet various government regulatory standards and industry operating standards. For example, the Association of America Railroads (AAR) has established standardized operating envelopes which define maximum allowed exterior dimensions for a wide variety of railway cars. Many advances have been made with respect to making railway cars stronger, lighter, larger in volume, greater load carrying capacity, easier to manufacture, and more aerodynamic. However, the search continues for improved railway cars that are even more efficient and cost effective.

Hopper cars and gondola cars may be used to transport a wide variety of goods and materials such as bulk commodities (corn, wheat, soy beans, etc.) and raw materials (coal, iron ore and other minerals). Gondola cars typically have a pair of sidewalls, a pair of end walls, a solid floor, and no roof. Hopper cars may be either open or covered depending upon the type of bulk lading which will be carried within the respective hopper car. A typical hopper car includes floor sheets which are sloped from the sides and ends of the car to form a series of pockets or hoppers with openings which allow discharge of the bulk lading.

In designing a railway car, it is desirable to maximize volume available for loading, while at the same time, maintaining exterior dimensions of the railway car within the appropriate AAR operating envelope.

Increasing volume may be achieved by minimizing the thickness of the associated sidewalls as long as the sidewalls maintain sufficient strength and durability for the associated loading. Side posts or side stakes are often provided to stiffen sidewalls to help carry lateral loads and beam loads.

Frequently, railway cars, such as hopper cars and gondola cars, have numerous side posts spaced along each side of the respective car to provide such support. Some conventional hopper cars may have eleven (11) or more side posts extending along each side of the respective car. Numerous side posts increase material cost and complexity of the design and manufacture of the associated railway car. Frequently, side posts are placed on the exterior of the associated sidewall to increase interior volume or cargo carrying capacity of the resulting railway car. However, exterior side posts, which often have a rectangular cross section, may increase aerodynamic drag and reduce railway car operating efficiency. Also, relatively thick exterior side posts limit potential increases in cargo volume as compared to a similar railway car with interior side posts.

SUMMARY OF THE INVENTION

In accordance with teachings of the present invention, a railway car is provided which substantially eliminates or reduces disadvantages and problems associated with previous railway cars. According to one aspect of the present invention, a railway car is provided with a pair of sidewalls respectively disposed on opposite sides of the car. Each sidewall is supported by side posts spaced longitudinally along the exterior of each sidewall. A longitudinal stiffener is also disposed along the interior surface of each sidewall. The side posts are load bearing members which cooperate with the longitudinal stiffeners to give increased support to the sidewalls of the railway car.

Technical advantages of the present invention include reducing the number and thickness of side posts required to support each sidewall of a railway car while increasing the cargo carrying capacity of the resulting railway car. Longitudinal stiffeners disposed along the interior surface of each sidewall increase the load carrying ability of the sidewalls and allow the use of thinner side posts. Manufacturing cost of the railway car may also be reduced by providing side posts and longitudinal stiffeners with substantially the same cross section. For some applications, the sidewall may be formed by overlapping metal sheets which are joined with each other by mechanical fasteners. The longitudinal stiffener of the present invention is preferably secured to the sidewall using the same mechanical fasteners which are used to attach the overlapping metal sheets with each other. As a result of incorporating teachings of the present invention, the number of mechanical fasteners required to form each sidewall and to attach the associated longitudinal stiffener may be minimized. This feature of the present invention reduces both manufacturing time and cost.

Another technical advantage according to one aspect of the invention, includes combining thin-but-stiff side posts with longitudinal stiffeners to allow the inside width of the resulting railway car to be increased, and thereby, increasing the volume of the railway car without exceeding the applicable AAR operating envelope.

BRIEF DESCRIPTION OF THE DRAWINGS

For a more complete understanding of the present invention and the advantages thereof, reference is now made to the following descriptions taken in conjunction with the accompanying drawings in which like reference numbers indicate like parts and wherein:

FIG. 3. is a schematic drawing with portions broken away showing an isometric view of one of the sidewalls of the railway car of FIG. 1;

FIG. 6 is an enlarged schematic drawing showing a cross sectional view of a side post or a longitudinal stiffen incorporating teachings of the present invention.

DETAILED DESCRIPTION OF THE INVENTION

The preferred embodiments of the present invention and its advantages are best understood by referring to FIGS. 1–6 of the drawings, like numerals being used for like and corresponding parts of the various drawings.

For purposes of illustration, the present invention will be described primarily with respect to open top railway cars such as gondola cars and/or hopper cars. Examples of such railway cars are shown and described in U.S. Pat. Nos. 5,209,166, entitled Aerodynamic Self Cleaning Hopper Car; 4,348,962, entitled Railway Hopper Car Bolster Assembly; 4,633,787 entitled Light Weight Gondola Type Railway Car; 3,844,229, entitled Railway Hopper Car End Structure Assembly; and 3,786,764, entitled Rapid Discharge Hopper Car. Although the present invention is generally described with respect to open top railway cars, a sidewall incorporating teachings of the present invention may be used with a wide variety of railway cars such as covered hopper cars with gravity discharge and/or pneumatic discharge systems.

Figure 1:
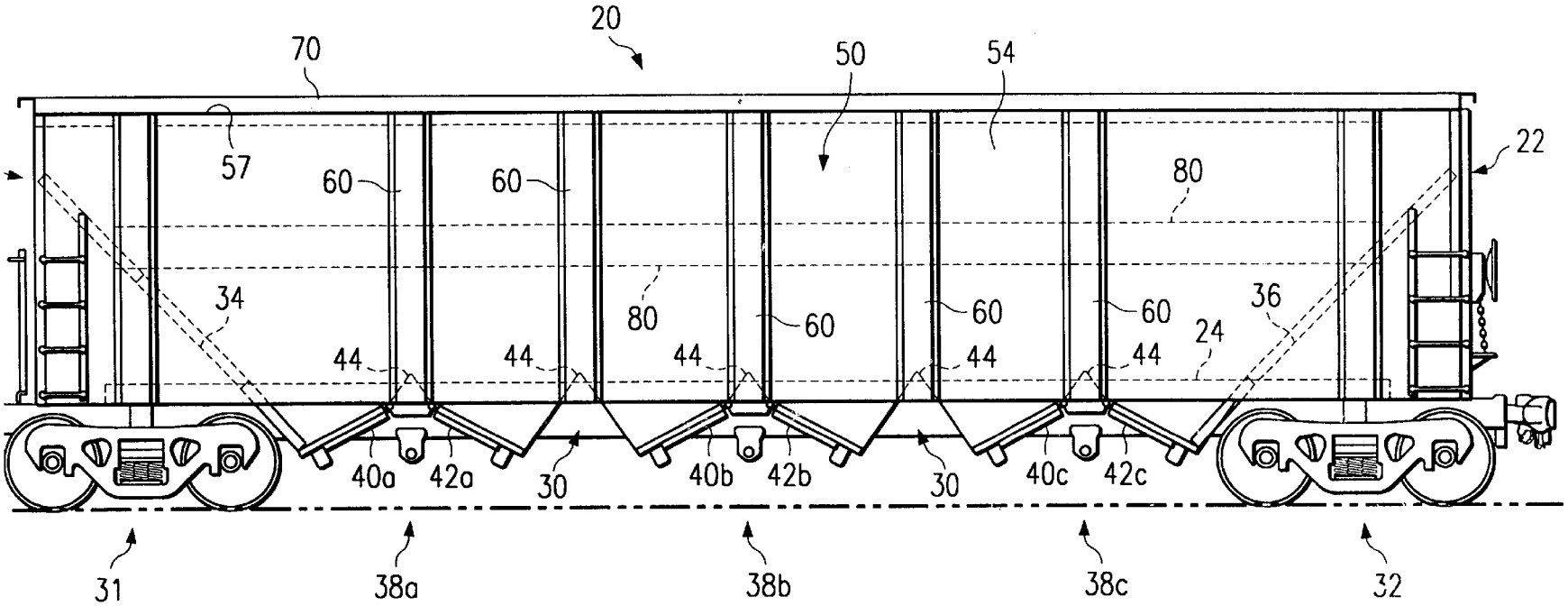
FIG. 1 is a schematic drawing in elevation with portions broken away showing a side view of a railway car having a pair of sidewalls incorporating teachings of the present invention.
Figure 2:
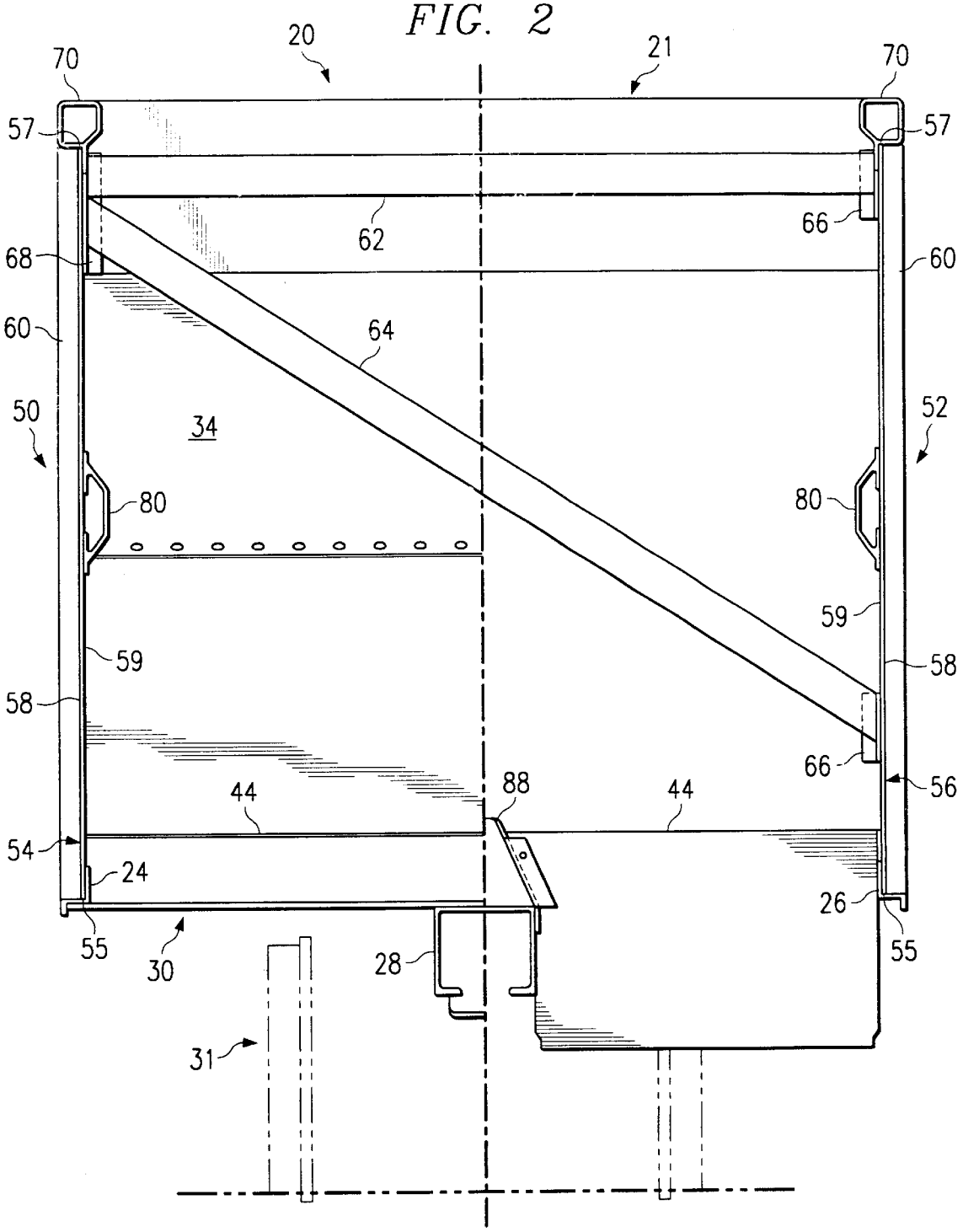
FIG. 2 is a schematic drawing in section with portions broken away show a split interior view of the railway car of FIG. 1.

FIGS. 1 and 2 show railway car 20 having a pair of sidewalls 54 and 56 incorporating various teachings of the present invention. Railway car 20 may be generally described as an open top gondola car, a coal car or a rapid discharge coal car. Sidewalls 54 and 56 have substantially the same design. However, for purposes of explaining various features of the present invention, reference will be made primarily to sidewall 54.

For some applications railway car 20 includes a railway car underframe indicated generally at 30 with car body 50 mounted thereon. For some applications, railway car underframe 30 is preferably manufactured from steel alloys and car body 50 is preferably manufactured from aluminum alloys. However, various components of both railway car underframe 30 and car body 50 may be satisfactorily formed from various steel alloys, aluminum alloys, fiber reinforced plastic materials, cermets, and composites of these materials as desired. As discussed later in more detail, fabricating a railway car with sidewalls having side posts and longitudinal stiffeners incorporating teachings of the present invention allows selecting materials which reduce manufacturing costs, while at the same time increasing load carrying capacity of the associated railway car.

Railway car underframe 30 is attached to and mounted on first railway truck assembly 31 adjacent to first end 21 of railway car 20. Railway car underframe 30 is also attached to and mounted on second truck assembly 32 adjacent to second end 22 of railway car 20. Various types of presently available railway car underframes and railway truck assemblies may be satisfactorily used with the present invention.

For the embodiments shown in FIG. 1, railway car 20 includes car body 50 having three discharge door assemblies or pairs 38 which are supported at least in part by underframe 30. For sake of clarity and convenience, the designations "a," "b," and "c" are used to differentiate between similar components of railway car 20 associated with respective discharge door assemblies 38*a,* 38*b,* and 38*c*. A railway car incorporating teachings of the present invention may have a car body with no discharge door assemblies or more or fewer discharge door assemblies than shown in FIG. 1. Hopper cars and gondola cars (either open top or covered) are typically designed for handling bulk commodities such as coal or grain. Railway car 20 as shown in FIG. 1 is designed for shipment of coal. Railway car 20 includes a plurality of transfer ridges 44 which extend laterally across the floor of car body 50. Transfer ridges 44 are preferably sloped to direct coal or similar lading toward the associated discharge door assembly 38. Each discharge door assembly 38 includes openings with doors 40 and 42 mounted respectively thereon. Doors 40 and 42 allow the discharge of bulk lading such as coal by gravity through the respective door assemblies 38*a,* 38*b*, and 38*c*. A similar type of door on a covered hopper car may sometimes be referred to as a discharge gate.

Rapid discharge door assemblies 38*a* and 38*c* are disposed adjacent to respective slope sheets 34 and 36 at respective ends 21 and 22 of railway car 20. Slope sheets 34 and 36 may be inclined at an angle of approximately forty-five degrees (45°) with respect to the top plane of railway car underframe 30. For some applications, partitions (not expressly shown) may be provided within car body 50 to separate rapid discharge door assembly 38*a* from rapid discharge door assembly 38*b* and rapid discharge door assembly 38*b* from rapid discharge door assembly 38*c*. For some applications, doors 40 and 42 may be automatically opened while railway car 20 is in motion to reduce unloading time. Such railway cars are sometimes referred to as rapid discharge cars. For other applications, railway car 20 may be modified to accommodate unloading by using rotary dumping equipment and techniques.

Car body 50 is defined in part by sidewalls 54 and 56 which extend generally parallel with each other along 30 opposite sides of railway car underframe 30. Each sidewall 54 and 56 includes a respective lower edge 55 and upper edge 57. Sidewalls 54 and 56 are also defined in part by exterior surface 58 and interior surface 59. For some applications, sidewalls 54 and 56 may be formed from a plurality of generally rectangular sheets of metal which are attached to each other using various types of mechanical fasteners and/or welding techniques. The arrangement of such metal sheets may be modified depending upon the desired configuration of the resulting sidewall. One such configuration will be discussed later with respect to FIG. 4B.

Railway car 20 includes a plurality of side posts or side stakes 60 which are spaced longitudinally from each other along respective exterior surfaces 58 of sidewalls 54 and 56. Lower edges 55 of respective sidewalls 54 and 56 are attached to adjacent portions of railway car underframe 30. For some applications, railway car underframe 30 will have a generally rectangular configuration defined in part by a pair of side sills 24 and 26. Lower edges 55 of respective sidewalls 54 and 56 will be attached to respective side sills 24 and 26 of railway car underframe 30 as shown in FIG. 2.

For some applications, car body 50 may include a plurality of cross ties 62 and/or diagonal braces 64 disposed between interior surface 59 of sidewall 54 and interior surface 59 of sidewall 56. Various types of brackets 66 and 68 may be used to attach the ends of cross ties 62 and diagonal braces 64 with interior surfaces 59. For some applications, a tapered or sloped hood 88 may be disposed longitudinally over center sill 28 of railway car underframe 30. Hood 88 preferably includes tapered sides to direct coal and similar types of lading into the associated rapid discharge assemblies 38.

A pair of longitudinal stiffeners 80 are preferably attached respectively to interior surfaces 59 of sidewalls 54 and 56. Each longitudinal stiffener 80 preferably extends between a location adjacent to first end 21 and a location adjacent to second end 22 of railway car 20. Each longitudinal stiffener 80 is also preferably attached to its associated interior surface 59 extending generally parallel with upper edge 57 and lower edge 55. The location of longitudinal stiffeners 80 may be varied depending upon the configuration of the associated railway car.

For some applications, more than one longitudinal stiffener 80 may be disposed on the interior surface of the associated railway car. For example, two longitudinal stiffeners incorporating teachings of the present invention may be disposed on the interior surface of a sidewall to increase the strength or load carrying capacity of the associated sidewall. Also, two or more longitudinal stiffeners having substantially the same configuration as longitudinal stiffener 80 but with a reduced volume (thickness) may be disposed on the interior surface of the associated sidewalls to increase the interior volume of the associated car body while maintaining substantially the same strength or load carrying capability. In a similar manner, the present invention allows adjusting the number and thickness of side posts 60 to optimize the interior volume of the associated car body while providing the desired strength and load carrying capability for the associated sidewall.

Side posts 60 are preferably attached to exterior surfaces 58 of sidewalls 54 and 56. Longitudinal stiffeners 80 are preferably attached to interior surfaces 59 of respective sidewalls 54 and 56. For some applications, side posts 60 and longitudinal stiffeners 80 may have substantially the same cross section such as shown in FIGS. 2–6. For example, side posts 60 and longitudinal stiffeners 80 may be formed by extruding selected aluminum alloy materials through a die having a configuration which will form a cross section such as shown in FIG. 6. The extruded strip of aluminum may then be cut into appropriate lengths for side posts 60 and/or longitudinal stiffeners 80. For other applications side posts 60 and longitudinal stiffeners 80 may have substantially different cross sections.

Figure 4A:
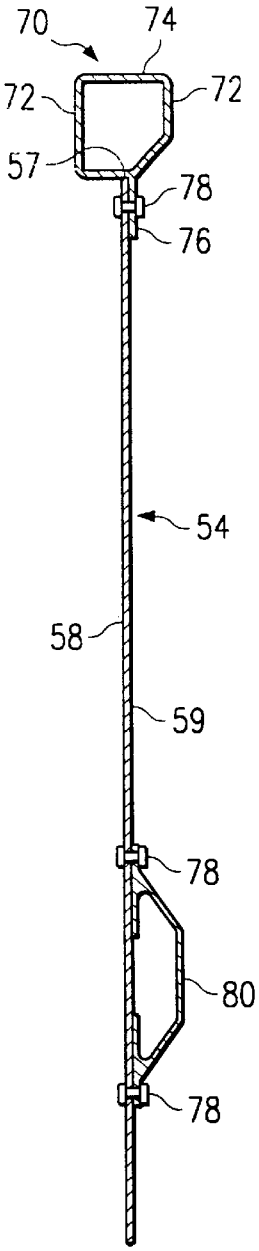
FIG. 4A is a schematic drawing in section with portions broken away showing the sidewall and longitudinal stiffener of FIG. 3.
Figure 5:
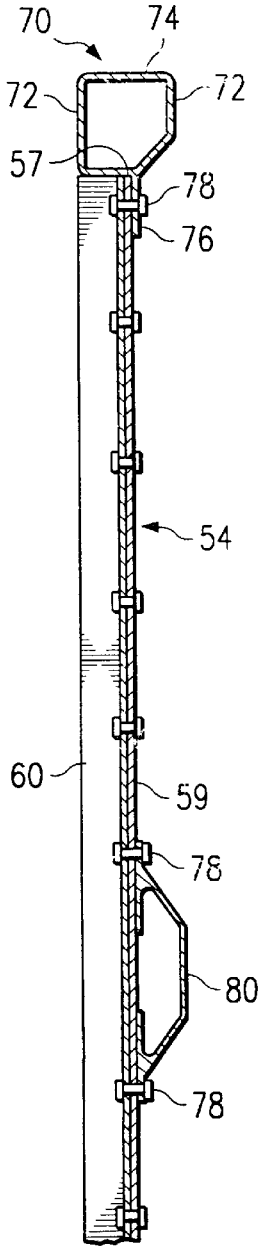
FIG. 5 is a schematic drawing in section with portions broken away showing the sidewall and the longitudinal stiffener of FIG. 3 along with a side post.

As shown in FIG. 2, top chords 70 are respectively attached along upper edges 57 of sidewalls 54 and 56. As best shown in FIGS. 3, 4A and 5, each top chord 70 preferably includes an elongated hollow member 72. Top chords having cross sections with various configurations may be satisfactorily used with the present invention. Elongated member 72 extends substantially along the full length of the respective sidewalls 54 and 56. Elongated member 72 includes top portion 74. Coupling member 76 is attached to and extends from elongated member 72 opposite from top portion 74. Coupling member 76 preferably extends along substantially the full length of the associated upper edge 57. A plurality of mechanical fasteners 78 may be used to attach coupling member 76 with adjacent portions of sidewalls 54 and 56.

Various types of mechanical fasteners such as nuts and bolts, drive bolts, blind rivets, and other fasteners may be satisfactorily used with the present invention. Examples of such fasteners are available from Huck International, Inc. located at 6 Thomas, Irvine, Calif. 92718-2585. Power tools satisfactory for installing such fasteners are also available from Huck International and other vendors.

For some applications various welding techniques may be used to satisfactorily attach respective top chords 70 with upper edges 57 of sidewalls 54 and 56. Also, a combination of welding techniques and mechanical fasteners may also be satisfactorily used. For railway car 20 as shown in FIGS. 1, 2 and 3, rivets are primarily used. Coupling member 76 is shown attached to interior surface 59 of the respective sidewalls 54 and 56. However, for some applications, coupling member 76 may be attached to exterior surface 58 of sidewalls 54 and 56.

FIG. 6 shows an enlarged view of the cross section associated with side posts 60 and longitudinal stiffeners 80. However, the present invention allows forming side posts and longitudinal stiffeners with a wide variety of cross sections. For purposes of explanation, the cross section shown in FIG. 6 will be described with respect to longitudinal stiffeners 80. Side posts 60 may have a corresponding cross section with substantially the same features as described with respect to longitudinal stiffeners 80.

Each longitudinal stiffener 80 preferably includes an elongated, hollow support body 82 having interior surface 84 and exterior surface 86. Elongated support body 82 has a generally trapezoidal cross section defined in part by first portion 91, second portion 92 and third portion 93. First portion 91 and third portion 93 extend at an angle from second portion 92. For some applications, the angles formed by the junction of second portion 92 with first portion 91 and third portion 93 may be approximately forty-five degrees (45°). When longitudinal stiffener 80 is attached to the associated interior surface 59, second portion 92 will extend substantially parallel with and spaced laterally from the respective sidewalls 54 and 56.

First portion 91 and second portion 93 may also be curved or may be disposed at an angle substantially normal to second portion 92. The configuration of elongated support body 82 may be varied in accordance with teachings of the present invention depending upon the type of lading which will be carried in the associated railway car. Forming first portion 91 and third portion 93 at an angle of approximately forty-five degrees (45°) relative to second portion 92 minimizes any interference caused by longitudinal stiffener 80 during loading or unloading of coal from railway car 20.

A pair of flanges 94 and 96 are preferably attached to and extend from elongated support body 82. First flange 94 is attached to first portion 91 opposite from second portion 92. In a similar manner, second flange 96 is attached to third portion 93 opposite from second portion 92. First flange 94 and second flange 96 have a generally rectangular configuration with a length corresponding with the length of elongated support body 82. First flange 94 and second flange 96 are aligned generally parallel with each other and parallel with second portion 92.

For the embodiment shown in FIG. 6, first flange 94 and second flange 96 each have respective portions 98 which extend from elongated support body 82. Each portion 98 preferably has an increased thickness as compared to other portions of flanges 94 and 96. Holes 106 are formed in portions 98 to provide locations for attaching longitudinal stiffener 80 with respective sidewalls 54 and 56 using mechanical fasteners 78. Alternatively, various welding techniques may also be used to attach portions 98 with sidewalls 54 and 56.

Interior portions 100 of each flange of first flange 94 and second flange 96 extends inwardly toward each other. Interior portions 100 of first flange 94 and second flange 96 increase the strength of elongated support body 82 and provide additional bearing surface between longitudinal stiffener 80 and the associated interior surface 59.

As previously noted, longitudinal stiffener 80 and side posts 60 may be extruded from aluminum alloys or other suitable, strong, lightweight materials. By using extrusion techniques, longitudinal stiffener 80 has a generally smooth continuous exterior surface 86 extending from edge 102 of first flange 94 to edge 104 of second flange 96. Providing longitudinal stiffeners 80 with a generally smooth continuous exterior surface minimizes any restrictions during loading or unloading of bulk cargo from railway car 20. Providing side posts 60 with a smooth continuous exterior surface minimizes aerodynamic drag of the associated railway car.

An important aspect of the present invention is that both side posts 60 and longitudinal stiffeners 80 have a relatively thin cross section but at the same time are relatively stiff and strong. As a result of this configuration, side posts 60 allow increasing the interior dimensions of railway car 20 extending between sidewalls 54 and 56 without exceeding the AAR design envelope for the associated railway car. In a similar manner, longitudinal stiffeners 80 substantially increase the strength of the associated sidewalls 54 and 56 without significantly reducing the interior volume of car body 50 available for carrying bulk commodities.

For one application, the width of longitudinal stiffener 80 measured from edge 102 of first flange 94 to edge 104 of second flange 96 is approximately 17 inches. For this same application the thickness of longitudinal stiffener measured from the exterior surface of first flange 94 is approximately 2 19/32 inches. In addition to increasing the strength of side posts 60, a cross section such as shown in FIG. 6 also provides improved aerodynamic characteristics as compared with conventional side posts having a generally rectangular cross section. The tapered configuration of first portion 91 and third portion 93 relative to second portion 92 provides reduced wind resistance or drag. In a similar manner, the angular configuration of first portion 91 and third portion 93 relative to second portion 92 eliminates any sharp edges which could possibly trap bulk commodities during loading or unloading of railway car 20.

Figure 4B:
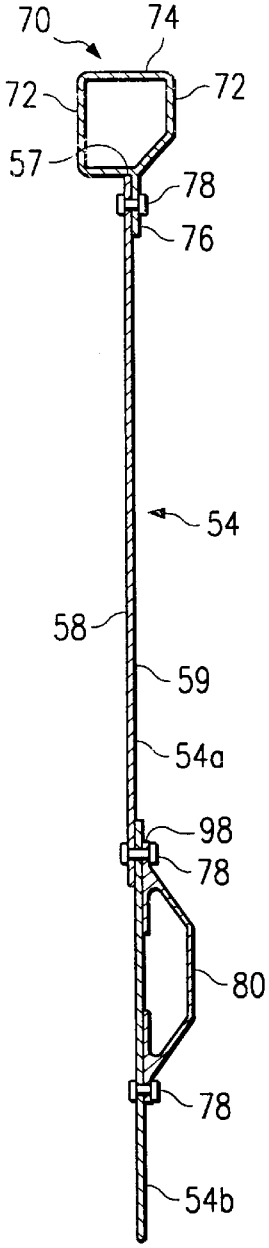
FIG. 4B is an enlarged schematic drawing in section with portions broken away showing the sidewall of FIG. 3 formed from overlapping metal sheets with a row of mechanic fasteners used to attach the overlapping metal sheets and the associated longitudinal stiffener with each other.

For purposes of illustration, sidewalls 54 and 58 are illustrated in FIGS. 2, 3, 4 A and 5 as being formed from a single, generally rectangular, flat sheet of metal. For many applications, sidewalls 54 and 56 will be formed from sheets of aluminum alloys satisfactorily for carrying coal or similar types of lading. Aluminum sheets are generally available in nominal widths of approximately ninety-six inches (96"). Since the height of sidewalls 54 and 56 is generally greater than ninety-six inches (96"), typically two or more metal sheets must be attached with each other to form sidewalls 54 and 56. For example, FIG. 4B shows sidewall 54 formed by overlapping first or upper metal sheet 54*a* with second or lower metal sheet 54*b*. A row of mechanical fasteners 78 may then be inserted through holes 106 in flange 94 and similar holes in the overlapping portions of metal sheets 54*a* and 54*b*. As a result, the number of mechanical fasteners used to attach longitudinal stiffener 80 with interior surface 59 may be reduced, while at the same time, increasing the strength of the mechanical connection between first metal sheet 54*a* and second metal sheet 54*b*. As shown in FIG. 3, the member of mechanical fastener 78 may also be minimized during the attachment of side posts 60 with exterior surface 58.

TYPICAL SPECIFICATIONS FOR
AN OPEN TOP HOPPER TYPE COAL CAR

| | |
|---|---|
| Length, Inside | 47'-3" |
| Width, Inside | 10'–1 3/8" |
| Length Over Coupler Pulling Faces | 53'–0 1/2" |
| Length Over Strikers | 50'–5" |
| Length Between Truck Centers | 40'–6" |
| Width, Extreme | 10'–7 15/16" |
| Height, Extreme | 13'–3 3/4" |
| Estimated Lightweight | 50,500 lbs. |
| Estimated Load Limit-Based on 286,000 lbs. G.R.L. | 235,500 lbs. |
| Gross Rail Load | 286,000 lbs. |
| Cubic Capacity | 4200 cu. ft. |
| Cubic Capacity-With 10" Heap | 4598 cu. ft. |

-continued

TYPICAL SPECIFICATIONS FOR
AN OPEN TOP HOPPER TYPE COAL CAR

| | |
|---|---|
| Center of Gravity Empty Car | 39.0" |
| Loaded to 286,000 lbs. G.R.L. Level Full | 87.6" |
| Loaded to 286,000 lbs. G.R.L. with 10" Heap | 92.0" |

By manufacturing substantially the same type of railway car with sidewalls incorporating teachings of the present invention, the interior cubic capacity of the resulting railway car may be increased from approximately 4200 cubic feet to approximately 4270 cubic feet. Manufacturing costs may also be reduced, aerodynamic performance of its railway car increased and possible obstructions for loading and unloading cargo reduced. The increase in cargo carrying capacity depends upon the dimensions selected for the associated side posts and longitudinal stiffeners.

Although the present invention has been described in detail, it should be understood that various changes, substitutions and alternations can be made hereto without departing from the spirit and scope of the invention as defined by the appended claims.

What is claimed is:

1. A railway car comprising:

a railway car underframe;

a first sidewall;

a second sidewall, the first and second sidewalls attached to and extending longitudinally along opposite sides of the railway car underframe, each sidewall having an interior surface and an exterior surface; and at least one longitudinal stiffener attached to the interior surface of at least one sidewall, the at least one longitudinal stiffener comprising a first portion, a second portion, and a third portion, the first and third portions extending at an angle from the second portion to define an interior, the at least one longitudinal stiffener further including a first flange attached to the first portion and a second flange attached to the third portion, wherein at least one of the first flange and second flange comprises a first flange portion extending from the at least one longitudinal stiffener and generally away from the interior, and a second flange portion extending from the at least one longitudinal stiffener and generally toward the interior, and wherein the first flange portion is thicker than the second flange portion.

2. The railway car of claim 1, wherein each of the first and second flanges has a first flange portion and a second flange portion, the respective first flange portions extending generally away from each other, the respective second flange portions extending generally toward each other.

3. The railway car of claim 1, wherein the at least one longitudinal stiffener has a length corresponding approximately with the longitudinal length of the at least one sidewall.

4. The railway car of claim 1, wherein the first portion, second portion, third portion, first flange and second flange define a generally trapezoidal cross section.

5. The railway car of claim 1, wherein the first flange and the second flange cooperate with each other to provide means for attaching the at least one longitudinal stiffener to the interior surface of the at least one sidewall.

6. The railway car of claim 1, further comprising at least one side post disposed on the exterior surface of the at least one side wall, wherein the at least one side post and the at least one longitudinal stiffener are formed with substantially the same cross section.

7. A railway car comprising:

a railway car underframe;

a first sidewall;

a second sidewall, the first and second sidewalls extending longitudinally along opposite sides of the railway car underframe;

at least one side post disposed on the exterior surface of at least one sidewall; and at least one longitudinal stiffener attached to the interior surface of the at least one sidewall wherein the at least one side post and the at least one longitudinal stiffener have substantially the same cross-sectional shape.

8. The railway car of claim 7, wherein the at least one side post and the at least one longitudinal stiffener are formed from an elongated strip of material having a desired cross section which has been cut into multiple pieces with respective lengths corresponding to a desired length for the at least one side post and a desired length for the at least one longitudinal stiffener.

9. The railway car of claim 7, wherein the at least one side post and the at least one longitudinal stiffener are formed from an integral strip of extruded aluminum alloy.

10. A longitudinal stiffener for attachment to a sidewall of a railway car, the longitudinal stiffener comprising:

a first portion;

a second portion;

a third portion, the first and third portions extending at an angle from the second portion to define an interior;

a first flange attached to the first portion; and a second flange attached to the third portion, wherein at least one of the first flange and second flange comprises a first flange portion extending from the longitudinal stiffener and generally away from the interior, and a second flange portion extending from the longitudinal stiffener and generally toward the interior, and wherein the first flange portion is thicker than the second flange portion.

11. The longitudinal stiffener of claim 10, wherein each of the first and second flanges has a first flange portion and a second flange portion, the respective first flange portions extending generally away from each other, the respective second flange portions extending generally toward each other.

12. The longitudinal stiffener of claim 10, wherein the first portion, second portion, third portion, first flange and second flange comprise an integral strip of material formed by extruding a selected aluminum alloy.

13. The longitudinal stiffener of claim 10, wherein the first portion, second portion, third portion, first flange and second flange define a generally trapezoidal cross section.

14. A sidewall for a railway car, comprising:

a sidewall member having an interior surface and an exterior surface, and adaptable to be connected to a railway car underframe;

at least one side post disposed on and attached to the exterior surface of the sidewall member; and at least one longitudinal stiffener disposed on and attached to the interior surface of the sidewall member, the at least one longitudinal stiffener comprising a first portion, a second portion, and a third portion, the first and third portions extending at an angle from the second portion to define an interior, the at least one longitudinal stiffener further comprising a first flange attached to the first portion and a second flange attached to the third portion, wherein at least one of the first flange and the second flange has a first flange portion extending from the at least one longitudinal stiffener and generally away from the interior, and a second flange portion extending from the at least one longitudinal stiffener and generally toward the interior, and wherein the first flange portion is thicker than the second flange portion.

15. A railway car comprising:

a railway car underframe;

a first sidewall;

a second sidewall, the first and second sidewalls attached to and extending longitudinally along opposite sides of the railway car underframe, each sidewall having an interior surface and an exterior surface, at least one sidewall comprising a plurality of sidewall sheets, wherein a first overlap portion of a first sidewall sheet overlaps a second overlap portion of an adjacent second sidewall sheet; and a longitudinal stiffener having an attachment surface attached to the interior surface of the at least one sidewall, wherein the attachment surface is disposed transversely inwardly from both the first and second overlap portions.

* * * * *